US007040095B1

(12) United States Patent
Lang

(10) Patent No.: US 7,040,095 B1
(45) Date of Patent: May 9, 2006

(54) METHOD AND APPARATUS FOR CONTROLLING THE FINAL FEEDWATER TEMPERATURE OF A REGENERATIVE RANKINE CYCLE

(76) Inventor: Fred D. Lang, 12 San Marino Dr., San Rafael, CA (US) 94901

( * ) Notice: Subject to any disclaimer, the term of this patent is extended or adjusted under 35 U.S.C. 154(b) by 0 days.

(21) Appl. No.: 11/204,898

(22) Filed: Aug. 16, 2005

Related U.S. Application Data

(60) Provisional application No. 60/609,551, filed on Sep. 13, 2004.

(51) Int. Cl.
*F01K 7/34* (2006.01)

(52) U.S. Cl. ..... 60/653; 60/679

(58) Field of Classification Search ..... 60/653, 60/679

See application file for complete search history.

(56) References Cited

U.S. PATENT DOCUMENTS 3,518,830 A * 7/1970 Dunnavant et al. ..... 60/657
3,842,605 A * 10/1974 Tegtmeyer ..... 60/678
4,336,105 A * 6/1982 Silvestri, Jr. ..... 60/644.1
5,267,434 A * 12/1993 Termuehlen et al. ..... 60/39.182
6,422,017 B1 * 7/2002 Bassily ..... 60/653

OTHER PUBLICATIONS

J. Kenneth Salisbury, "Steam Turbines and Their Cycles", Krieger Publishing Co., Huntington, NY, pp. 43-93 and 266-273.

* cited by examiner

*Primary Examiner*—Hoang Nguyen

(57) ABSTRACT

This invention relates to a method and apparatus for controlling the final feedwater temperature associated with a regenerative Rankine cycle, said cycle commonly used in thermal systems such as conventional power plants. This invention involves the placement of a new heat exchanger, termed an Exergetic Heater, in the feedwater path downstream from the highest pressure feedwater heater to assure that the feedwater is properly heated to its final temperature before entering the steam generator. The heating of the feedwater is accomplished by routing steam from the Intermediate Pressure turbine, which normally is routed to the second highest pressure heater. Control of the final feedwater temperature is achieved through a control valve whose actuation adjusts the amount of steam flow being routed from the Intermediate Pressure turbine to the Exergetic Heater.

18 Claims, 4 Drawing Sheets

- prior art -

- prior art -

METHOD AND APPARATUS FOR CONTROLLING THE FINAL FEEDWATER TEMPERATURE OF A REGENERATIVE RANKINE CYCLE

CROSS-REFERENCE TO RELATED APPLICATION

This application claims benefit of priority of U.S. Provisional Application No. 60/609,551 filed Sep. 13, 2004 by the same inventor, the disclosure of which is incorporated herein by reference in its entirety and for all purposes.

FIELD OF THE INVENTION

This invention relates to a method and apparatus for controlling the final feedwater temperature associated with a regenerative Rankine cycle, said cycle commonly used in thermal systems such as conventional power plants. This invention involves the placement of a new heat exchanger, termed an Exergetic Heater, in the feedwater path downstream from the highest pressure feedwater heater to assure that the feedwater is properly heated to its final temperature before entering the steam generator. The heating of the feedwater is accomplished by routing steam from the Intermediate Pressure turbine, which normally is routed to the second highest pressure heater. Control of the final feedwater temperature is achieved through a control valve whose actuation adjusts the amount of steam flow being routed from the Intermediate Pressure turbine to the Exergetic Heater.

BACKGROUND OF THE INVENTION

The regenerative Rankine cycle has been used by the electric power industry for over 100 years. Most commonly the working fluid in these cycles is water. The regenerative Rankine cycle takes steam from a steam generator, produces shaft power by expanding the steam in a turbine, and then condenses the expanded steam in a condenser. Heating of the cycle's working fluid occurs in the steam generator, which may be driven by the combustion of fossil fuel Many modern regenerative Rankine cycles employ a reheating of the steam after an initial expansion in a High Pressure (HP) turbine. After reheating in a Reheater heat exchanger, integral to the steam generator, the steam is returned to the cycle for further expansion in an Intermediate Pressure (IP) turbine, followed by expansion in a Low Pressure (LP) turbine; the LP turbine's exhaust is then condensed in a condenser. If an IP turbine is present (accepting steam from a Reheater), its exhaust temperature is commonly higher than the HP turbine's exhaust temperature. The condensate from the condenser, or feedwater, is then routed by pumps through a series of feedwater heaters in which it is re-heated (regenerated). The heating vehicle for the feedwater is extraction steam obtained from the turbine. Feedwater heaters may be of a contact type or a closed type of heat exchanger. A closed type of heater is also termed a surface type heater, this type of heater has a shell-side and a tube-side configuration where, typically, the shell-side contains the heating fluid and the tube-side contains the fluid being heated. With a contact type of heater the extraction steam is directly mixed with feedwater, the heated feedwater/condensed steam being pumped to the next highest pressure heater. With a closed type of heater the extraction steam is contained on the shell-side of the heat exchanger, the feedwater carried within tubes A classical text on the subject of regenerative Rankine cycles used in power plants is by J. Kenneth Salisbury, *Steam Turbines and Their Cycles*, Robert E. Krieger Publishing Company, Huntington, N.Y., 1950 (reprinted 1974), especially pages 43–93 and 266–273.

For feedwater heaters the heating mechanism involves condensation of turbine extraction steam, its latent heat transferred to the feedwater. Condensing heat transfer is solely dependent on the saturation temperature associated with the extracting steam, and is thus dependent on the extraction pressure delivered by the turbine. Extraction pressures are governed by the turbine's Flow Passing Ability as integrally established by the next downstream nozzle from the point of extraction. The Flow Passing Ability at any point in a steam turbine represents a reduction of Bernoulli's Equation associated with fluid passing through a nozzle (in the case of a turbine, a ring of nozzles forming the inlet to a turbine stage). When nozzles erode their flow area increases, causing, for a given mass flow, a reduction in inlet pressure and thus a reduction in the associated extraction pressure. A degradation in extraction pressure will degrade a feedwater heater's condensing heat transfer mechanism resulting in a lower feedwater temperature.

The typical design practice in North America is to supply the highest pressure feedwater heater its extraction steam from the HP turbine's exhaust. This highest pressure feedwater heater is the last heater the feedwater encounters before returning to the steam generator (it is also termed the "top heater"). The second highest pressure feedwater heater is supplied extraction steam from the IP turbine. The third highest pressure feedwater heater is supplied extraction steam from the next lowest extraction pressure available from the turbine; and so forth. Refer to FIG. 1.

A common design practice in Europe is to supply the top heater its extraction steam from a mid-point IP turbine extraction, and to supply the next to the top feedwater heater its extraction steam from the HP turbine's exhaust. An improved balance of shell-side to tube-side differential exergies is obtained using this design, even through the second highest pressure extraction steam (from the IP turbine) is used to heat the top heater. The shell-side outlet of the top heater is then routed to a third feedwater heater, as is the drain flow from the second heater. With the European design, the third feedwater heater does not receive extraction steam directly from the turbine. There is no known design, including European, which extracts steam from a turbine to directly heat both the top heater and the third feedwater heater, i.e., heaters placed in series along the feedwater path. Refer to FIG. 2. There is no known application where the turbine extraction leading to a top heater in an European design is adjusted to affect the final feedwater temperature. It is known that a single LP turbine extraction may be designed to deliver steam to a plurality of feedwater heaters, but heaters operating, at design, with the same inlet feedwater conditions. For example, if a regenerative Rankine cycle's LP feedwater heaters contain two groups of heaters, say 5A, 6A & 7A, and 5B, 6B & 7B (where 7A & 7B are the lowest pressure heaters both receiving condensate from the condenser, 5A and 5B being the highest pressure heaters), then a single turbine extraction may supply heaters 5A and 5B, another extraction supplying heaters 6A and 6B, and another extraction supplying heaters 7A and 7B. In yet another variation, as favored by the Westinghouse Electric Corporation, it could be that heater 5A is being supplied an extraction which is different than that which heater 5B is being supplied; i.e., asymmetric extractions. However, there is no known design which extracts a single source of steam from an LP turbine and supplies, for example, heaters 5A and 6B, or 6B and 7B, or 7A and 5A, etc. (i.e., heaters placed in series along the feedwater path). In summary, there is no known art which advocates using a single turbine extraction to supply a plurality of feedwater heaters placed in series along the feedwater path.

The High Pressure (HP) turbine's exhaust pressure is controlled by the next downstream turbine's Flow Passing Ability. The next downstream turbine is typically the Intermediate Pressure (IP) turbine. Thus if the nozzles associated with the first stage of an IP turbine erode, the exhaust pressure associated with the HP turbine will degrade, and will thus degrade the associated feedwater heater. In summary: the inlet area of the first nozzles of an IP turbine will control all upstream pressures to the HP turbine: throughout the Reheater heat exchanger, the Reheater piping, and indeed the HP turbine's backpressure (the HP exhaust). When the HP turbine's exhaust is bled to the highest pressure feedwater heater and the IP inlet nozzle area has eroded, extraction pressure to this heater and thus its saturation temperature will degraded, and thus final feedwater temperature will degrade.

Inlet nozzles of IP turbines erode, typically from solid particles trapped in the steam. Traditionally, and especially for the older machine, they go un-repaired for years given that full electrical generation may still be achieved using higher feedwater flows, and with ever increasing consumption of fuel and combustion air. This situation is aggravated if the power plant's over-sight authority (typically a public utility commission or public service commission) allows ever higher fuel costs to be passed onto the electricity customers. However, eventually capacity issues arise from such higher flows. Examples of equipment limitations resultant from such higher flows include: limitations imposed by a combustion air fan; limitations imposed by an induce draft fan controlling combustion gas back-pressures; limitations imposed by a coal mill's capacity; limitations imposed by the capacity of feedwater pumps; limitations imposed by an auxiliary steam turbine driving a feedwater pump; and the like.

Responsible power plant operators are in need of a solution to such a problem. There is no known art which has addressed the issue of IP turbine nozzle erosion at the operational level, when on-line. IP turbine nozzle erosion will degrade the final feedwater temperature on North American steam plants, and will affect system thermal efficiency causing a higher consumption of fuel.

SUMMARY OF THE INVENTION

The present invention teaches to route the first IP turbine extraction steam to a new heat exchanger placed downstream from the highest pressure feedwater heater and before the steam generator, in addition to its normal routing to the second highest pressure heater. An extraction from the IP turbine has an appropriate energy flow (given its reheating) for feedwater heating associated with the new heater. The new heater is termed an "Exergetic Heater". Exergy is a thermodynamic term relating to the maximum potential for power production; thus an Exergetic Heater, used in the fashion taught herein, assists the turbine cycle in achieving maximum power. The Exergetic Heater has the capacity to always heat the feedwater to its final conditions, no matter the reason for a degradation in the feedwater heater's performance (by IP turbine nozzle erosion, higher extraction line pressure drops, degradation in heater performance from non-condensable gas buildup, etc.). It is an important feature of the present invention to use IP extraction steam since its temperature is sufficiently high to cause the proper heating of the feedwater within the Exergetic Heater using minimum flow. In the preferred embodiment the Exergetic Heater has a shell-side and a tube-side configuration. By design, the motive steam enters the shell-side of the Exergetic Heater as superheated steam and exits as saturated steam or subcooled liquid; the exiting fluid then enters a lower pressure feedwater heater having sufficient exergy to assist feedwater heating at that point in the cycle. The present invention also teaches the use of a single turbine extraction to supply a plurality of feedwater heaters placed in series along the feedwater path.

Although not limited to power plant designs found in North America, for the typical North American power plant the present invention teaches that a portion of an IP turbine's steam can be used to heat feedwater such that degradation to its final feedwater temperature may be eliminated through use of an Exergetic Heater. Such heating is achieved through control of the IP extraction steam flow being delivered to the Exergetic Heater as based on a final feedwater temperature set-point. When implemented, this invention eliminates the affects of degradation in final feedwater temperature. Broadly, the present invention teaches now to eliminate degradation in final feedwater temperature associated with the regenerative Rankine cycle. Other advantages of the present invention will become apparent when its methods and apparatus are considered in conjunction with the accompanying drawings and discussions.

BRIEF DESCRIPTION OF THE DRAWINGS

As seen in FIG. 3 the outlet flow from the Exergetic Heater is routed to a lower pressure heater.

DESCRIPTION OF THE PREFERRED EMBODIMENTS

Figure 1:
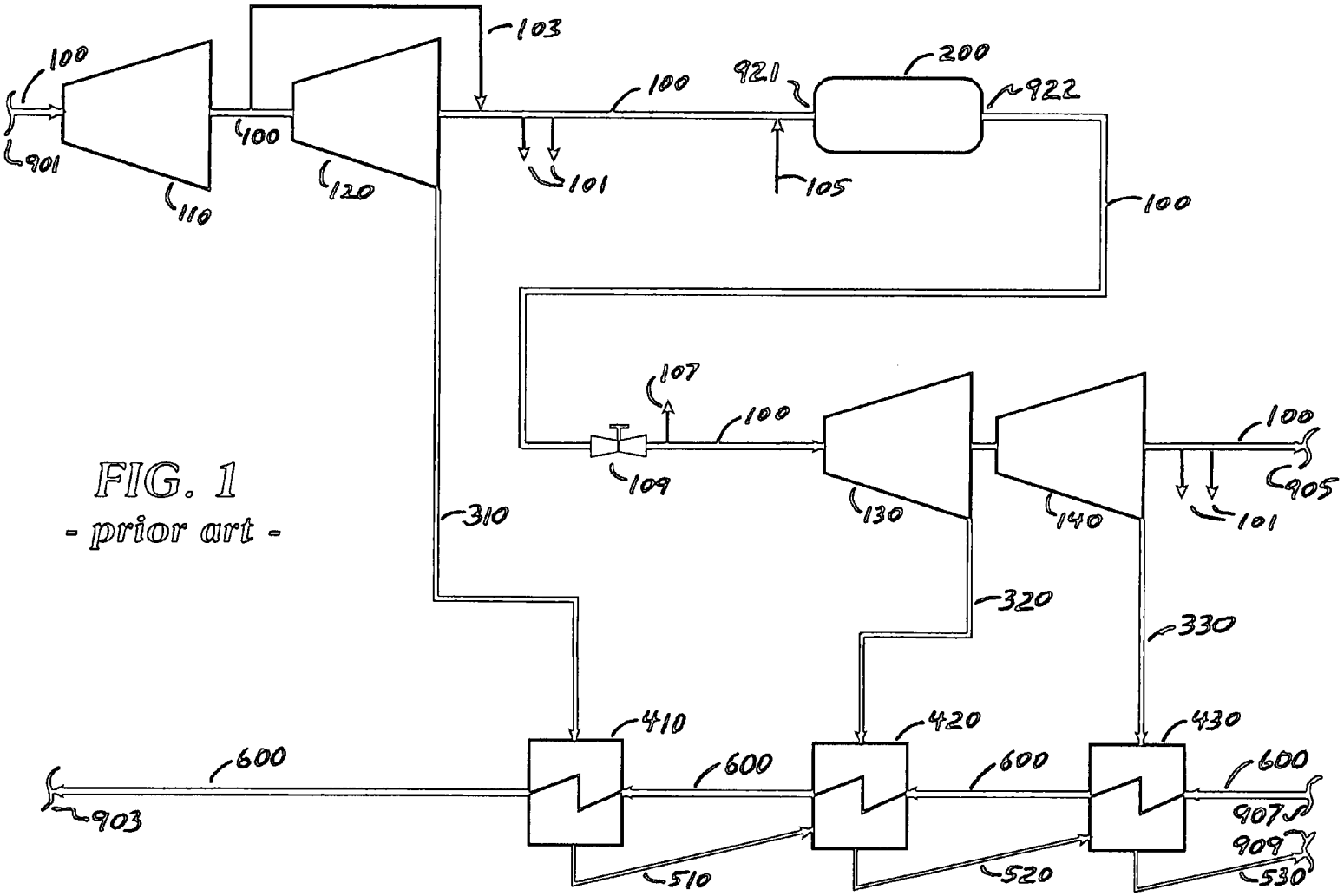
FIG. 1 illustrates a portion of a typical regenerative Rankine cycle of conventional design commonly used in North America, it is an example of prior art.

The teaching of the present invention is divided into three sections. The first section discusses the impact a degraded final feedwater temperature has on system thermal efficiency considering individual impacts on the regenerative Rankine cycle (i.e., turbine cycle efficiency) and on the steam generator (i.e., boiler efficiency). The second section discusses a steam turbine's Flow Passing Ability at the inlet to an IP turbine. IP inlet nozzle degradation impacts the regenerative Rankine cycle by degrading final feedwater temperature. The final section teaches the implementation of the present invention which overcomes the effects on system thermal efficiency of degraded final feedwater temperature.

Final Feedwater Temperature

The system thermal efficiency of a power plant employing a regenerative Rankine cycle may be affected by internal interface conditions (i.e., boundaries) between the regenerative Rankine cycle and the steam generator. The energy flow supplied to the regenerative Rankine cycle from the steam generator is termed the "Useful Energy Flow Supplied" ($\Sigma m\Delta h$). By a boundary condition is meant the fluid's pressure and temperature (or quality) and resulting enthalpy (h), and the fluid's mass flow (m). For any power plant, system (or "unit") thermal efficiency is given by:

$$\eta_{Unit}=\eta_{TC}\eta_B \tag{1}$$

The efficiency of the regenerative Rankine cycle (also termed turbine cycle efficiency) is given as:

$$\eta_{TC}=P/\Sigma m\Delta h \tag{2}$$

Boiler efficiency may be expressed traditionally by Eq.(3), noting it employs a higher (gross) heating value as commonly used in North America. In Europe the lower (net) heating value (LHV) is used to define boiler efficiency. Use of HHV or LHV is not material to the present invention, either may be employed if used consistently as in Eqs.(3), (4B), (4C), etc.

$$\eta_B=\Sigma m\Delta h/(m_{AF}HHV) \tag{3}$$

Substitution of these equations leads to Eq.(4C), a classical definition of system thermal efficiency of useful power output divided by input energy flow:

$$\eta_{Unit}=[P/\Sigma m\Delta h]\eta_B \tag{4A}$$

$$\eta_{Unit}=\eta_{TC}[\Sigma m\Delta h/(m_{AF}HHV)] \tag{4B}$$

$$\eta_{Unit}=P/(m_{AF}HHV) \tag{4C}$$

In the above equations, and elsewhere herein:

$\eta_{Unit}$=System (unit) thermal efficiency, unitless; note that "heat rate" commonly used in the power industry is defined as $3412.1416/\eta_{Unit}$ for Btu/kWh units of measure (or $36000.0/\eta_{Unit}$ for kJ/kWh units of measuure);

$\eta_B$=Steam generator (boiler) efficiency, unitless;

$\eta_{TC}$=Thermal efficiency of the regenerative Rankine cycle (turbine cycle), unitless;

$\Sigma m\Delta h$="Useful Energy Flow Supplied" to the working fluid from the steam generator, Σmass flow (m) times specific enthalpy changes (Δh), Btu/hr (kJ/sec). For a typical regenerative Rankine cycle used in a power plant, the term $\Sigma m\Delta h$ may be defined by the following quantities:

$$\Sigma m\Delta h=m_{FW}(h_{Throttle}-h_{Final\text{-}FW})+m_{RH}(h_{HRH}-h_{CRH}) \tag{5}$$

$h_{Throttle}$=Specific enthalpy from the steam generator delivered at the turbine cycle's boundary (i.e., the Throttle Valve located immediately upstream from the HP turbine), Btu/lbm (kJ/kg);

$h_{Final\text{-}FW}$=Specific enthalpy of the final feedwater delivered to the steam generator, Btu/lbm (kJ/kg);

$m_{RH}$=Reheat flow, lbm/hr (kg/sec);

$h_{HRH}$=Specific enthalpy from the steam generator delivered at the turbine cycle's boundary (i.e., the Intercept Valve located immediately upstream from the IP turbine, termed "Hot Reheat"), Btu/lbm (kJ/kg);

$h_{CRH}$=Specific enthalpy from the HP turbine's exhaust (termed "Cold Reheat") as routed to the steam generator, Btu/lbm (kJ/kg);

HHV=Higher heating value of the As-Fired fuel, Btu/lbm (kJ/kg);

$m_{AF}$=As-Fired (actual) fuel flow to the steam generator, lbm/hr (kg/sec);

$m_{FW}$=Final feedwater flow, lbm/hr (kg/sec);

P=Useful power output from the system as thermal or electrical power (e.g., gross electrical generation, Btu/hr (kJ/sec);

$T_{Final\text{-}FW}$=Final feedwater temperature, ° F. (° C.).

By examining these terms it becomes obvious that when the Useful Energy Flow Supplied ($\Sigma m\Delta h$) becomes degraded (i.e., increases for a constant power output), that turbine cycle efficiency ($\eta_{TC}$) will decrease. Increases (degradation) in $\Sigma m\Delta h$ may occur through changes to any term of Eq.(5); $\Sigma m\Delta h$ will increase given a decrease in the final feedwater enthalpy, $h_{Final\text{-}FW}$, given a decrease in the final feedwater temperature, $T_{Final\text{-}FW}$.

To more fully understand the relationship between system, turbine cycle and boiler efficiencies, propose that a change in turbine cycle efficiency is exactly off-set by an opposing change in boiler efficiency; thus no change in system thermal efficiency. However, if assuming constant power, a change in turbine cycle efficiency means a change in the Useful Energy Flow Supplied ($\Sigma m\Delta h$). Indeed, since $\Sigma m\Delta h$ appears in the numerator of turbine cycle efficiency and in the denominator of boiler efficiency, effects might cancel. But if affects on $\eta_{TC}$ at constant power are to be just off-set by $\eta_B$, then fuel energy flow must remain constant. However, thermodynamics suggests this can not be the case; system thermal efficiency must change. The conundrum is that any change in $\Sigma m\Delta h$ will integrally affect the steam generator's fuel energy flow, $m_{AF}$HHV. The relationship between these two energy flows, which is boiler efficiency of Eq.(3), is not dependent on rigid linearity between turbine cycle efficiency and $\Sigma m\Delta h$ (given constant power). Indeed, for a steam generator the relationship between $\Sigma m\Delta h$ and $m_{AF}$HHV is non-linear for the following reasons. First, the fluids employed in a steam generator have completely different Maxwellian relationships. An incremental change in $(\partial h/\partial P)_T$ for water is not that for its heating medium the combustion gas if heating working fluid via fossil fuel, nor for the fission process if heating in a nuclear reactor. Thus an incremental change in Carnot conversion of a change in water's $\Sigma m\Delta h$ to ideal work is not that associated with an incremental change its instigating fuel. For example, a change in $h_{Final\text{-}FW}$ must affect the Economizer's exiting combustion gas in a conventional power plant (the first exchanger encountered in the steam generator) in a non-linear manner. This will have non-linear effects on the exit boundary conditions of the steam generator, and thus on boiler efficiency. Second, a differential change in thermal energy, $\partial(\Sigma m\Delta h)$, must result in a different differential change in chemical energy, $\partial(m_{AF}HHV)$. Again, to invoke Maxwell relationships, $(\partial h/\partial P)_T$ for water varies with operating temperature, $(\partial h/\partial P)_T$ for a fossil fuel is essentially constant. To state otherwise would suggest the ratio of $(\partial h/\partial P)_T$ between water and a fossil (or nuclear) fuel is constant, leading to a linear relationship between boiler efficiency (or the efficiency of the nuclear steam supply system) and load. There is no known steam generator having such a performance profile.

If $\Sigma m\Delta h$ increases by 2% given a decrease in $h_{Final\text{-}FW}$, at constant power, turbine cycle efficiency will decrease by 2%. If boiler efficiency has been found to change due to a 2% change in $\Sigma m\Delta h$, then $m_{AF}$HHV will change by something other than 2%. Thus system thermal efficiency will have changed.

Second Law concepts produce a systems view. One approach is to differentiate Eq.(1) by power (or exergy); see Eqs.(6B) & (6C). For this and the following paragraph, the indicated partial derivatives are based on holding environmental factors constant. Allow power its variability. The result indicates if fuel energy flow is increased resulting in a higher power output, as converted by system thermal efficiency, that the governing term $[\eta_{Unit}\partial(m_{AF}HHV)/\partial P]$ must then be less than unity to produce an increase in system thermal efficiency (i.e., $\partial\eta_{Unit}/\partial P>0.0$).

$$\partial\eta_{Unit}/\partial P=\partial(\eta_{TC}\eta_B)/\partial P \tag{6A}$$

$$\partial\eta_{Unit}/\partial P=\{1.0-\eta_{Unit}\partial(m_{AF}HHV)/\partial P\}/(m_{AF}HHV) \tag{6B}$$

$$\partial\eta_{Unit}/\partial P=\{1.0-[\partial(m_{AF}HHV)/m_{AF}HHV]/[\partial P/P]\}/(m_{AF}HHV) \tag{6C}$$

The governing term in Eq.(6C) being less than unity to achieve an improved system thermal efficiency, implies a most unusual case where a relative increase in fuel energy flow leads to an even larger relative increase in power output. In summary, a relative increase in fuel energy flow with a concomitant increase in power, caused for example by a change in $h_{Final\text{-}FW}$, will not improve system thermal efficiency unless $[\eta_{Unit}\partial(m_{AF}HHV)/\partial P]<1.0$.

Another and more direct approach is to differentiate Eq.(1) by the Useful Energy Flow Supplied ($\Sigma m\Delta h$). The result of Eq.(8), following from Eq.(7B) where power is held constant $\partial P=0.0$, indicates that when an increase in $\Sigma m\Delta h$ results in an increase in fuel energy flow, thus $[\partial(m_{AF}HHV)/\partial(\Sigma m\Delta h)]>0.0$, that system thermal efficiency will always decline.

$$\partial\eta_{Unit}/\partial(\Sigma m\Delta h)=\partial(\eta_{TC}\eta_B)/\partial(\Sigma m\Delta h) \tag{7A}$$

$$\partial\eta_{Unit}/\partial(\Sigma m\Delta h)=[\partial P/\partial(\Sigma m\Delta h)-\eta_{Unit}\partial(m_{AF}HHV)/\partial(\Sigma m\Delta h)]/(m_{AF}HHV) \tag{7B}$$

$$[\partial\eta_{Unit}/\partial(\Sigma m\Delta h)]_P=-\eta_{Unit}[\partial(m_{AF}HHV)/\partial(\Sigma m\Delta h)]_P/(m_{AF}HHV) \tag{8}$$

Eq.(8) also suggests that if an increase of any magnitude in $\Sigma m\Delta h$ results in a decrease in fuel energy flow, that system thermal efficiency will improve provided power output is held constant. This would suggest, in the extreme, that a 50% increase in $\Sigma m\Delta h$ could result in less fuel consumed! Again, invoking the arguments made above, such a situation will lower $\eta_{TC}$, and, if $\eta_{Unit}$ is to be improved, means a $\geqq$50% improvement in boiler efficiency! This observation teaches as applied thermodynamics, that no improvement in system thermal efficiency may be expected from any increase in $\Sigma m\Delta h$, no matter how small, provided power is held constant. Thus the issue reduces, given a perturbation in the turbine cycle, to understanding changes in boiler efficiency, Eq.(3). Any in-situ thermal system, operating with a defined and constant environment, will convert a relative change to its fuel energy flow to a relative thermal output, $\Delta(\Sigma m\Delta h)/\Sigma m\Delta h$, by a continuous boiler efficiency function. To do otherwise would violate Carnot's teachings. It would suggest that a Carnot conversion of thermal energy flow to ideal shaft power is discontinuous, different incrementally for a given $\partial(m_{AF}HHV)$ change. On the other hand, if it is proposed that both power output (P) and fuel energy flow ($m_{AF}HHV$) remain constant, but $\Sigma m\Delta h$ varies, then Eq.(4C) would then suggest system thermal efficiency is constant. Under this proposal, any change to $\Sigma m\Delta h$ would be exactly off-set by a counter-acting change in boiler efficiency, see Eq.(4A); but which must imply an off-setting change in the system's fuel energy flow ($m_{AF}HHV$). Thus, again, it is impossible to envision a change in $\Sigma m\Delta h$ without affecting boiler efficiency. It is impossible to envision a negative value for $[\partial(m_{AF}HHV)/\partial(\Sigma m\Delta h)]$ when assuming extreme situations.

In summary, although a degraded final feedwater temperature may not always degrade boiler efficiency ($\eta_B$), if such a degradation in final feedwater temperature results in an increase in fuel energy flow (even with an increase in boiler efficiency), system thermal efficiency will always decline. The impact on boiler efficiency will be non-linear when compared to its impact on turbine cycle efficiency. For a fossil-fired system, a degraded final feedwater temperature may result in a lower combustion gas boundary temperature (i.e., Stack temperature); this would result, all other conditions remaining constant, in an improved boiler efficiency and lower fuel flow. However, a reduced Stack temperature will upset conditions elsewhere in the system given affects on downstream working fluid and associated combustion gas conditions. Examples of this may include: a reduced temperature inlet to the IP turbine; a readjustment of spray flows controlling HP and IP turbine inlet conditions, changes in economizer outlet conditions, etc. Whatever the cycle complexities, a degraded final feedwater temperature may easily result in a lower system thermal efficiency. It becomes necessary then, when fully implementing the present invention, to use automatic controls to determine turbine cycle and boiler efficiencies in real-time. Boiler efficiency must be determined independent of fuel flow for coal-fired units given the uncertainties found in metering coal flow.

For fossil-fired steam generators, the determination of boiler efficiency is considered established art. Any of the following procedures may be employed to determine boiler efficiency as required to support the full teachings of the present invention: the Input/Loss Method of computing boiler efficiency as taught in U.S. Pat. No. 6,584,429 (hereinafter referred to as the "Input/Loss Method"); the method taught by the American Society of Mechanical Engineers, Performance Test Code 4 (hereinafter referred to as the "ASME PTC 4 Method"); the method taught by the American Society of Mechanical Engineers, Performance Test Code 4.1 (hereinafter referred to as the "ASME PTC 4.1 Method"); methods taught by the German standard "Acceptance Testing of Steam Generators", DIN 1942, DIN DEUTSCHES Institut Fur Normung E. V. (hereinafter referred to as the "DIN 1942 Method"); the Shinskey control method as referenced in F. G. Shinskey, *Energy Conservation Through Control*, Academic Press, 1978, pages 102–104 and similar real-time control oriented methods (hereinafter collectively referred to as the "Control-Oriented Method"); methods employed by a power plant's distributed control (computer) system such as those provided by ABB Utilities of Mannhiem, Germany and its subsidiaries & affiliated companies, by Siemens of Munich, Germany and its subsidiaries & affiliated companies, ALSTOM of Baden, Switzerland and its subsidiaries & affiliated companies, by Emerson Electric Company of St Louis, Mo. and its subsidiaries & affiliated companies, and similar distributed control systems (DCS, hereinafter referred to as the "DCS-Based Method"); and/or any other reputable method of computing boiler efficiency. The preferred embodiment for computing boiler efficiency as applicable to a fossil-fired steam generator is the Input/Loss Method.

Flow Passing Ability and the IP Turbine

The causes of a decrease in the final feedwater enthalpy, $h_{Final\text{-}FW}$, thus degrading $\Sigma m\Delta h$, may occur through any one or all of the following: non-condensable gas blanketing of the heat transfer surface area (i.e., improper venting);

unusual increase in the extraction line pressure drop; liquid level control problems in the heater's drain section; changes in extraneous (non-extraction) steam entering the heater; and erosion of the IP inlet nozzles. Of these reasons for degradation, all but erosion of the IP inlet nozzles may be repaired while on-line or their effects eliminated through operational changes. The most common reason for long-term decline in system thermal efficiency associated with turbine cycle boundary conditions is degradation in the final feedwater temperature as caused by erosion of the IP turbine's inlet nozzles.

The design steam mass flow passing through a turbine's nozzle is a function of the turbine's design characteristics, its nozzle's inlet steam pressure and specific volume, and its design mass flow rate. From these considerations its design Flow Passing Ability constant ($K_{Design}$) may be determined using Eq.(9). In Europe the Flow Passing Ability constant is termed the turbine's Swallowing Capacity. Using $K_{Design}$, the actual inlet mass flow at actual conditions may then be computed from Eq.(10).

$$K_{Design} = m_{B-Design} \Big/ \sqrt{(P/v)_{B-Design}} \tag{9}$$

$$m_{B-Calc} = K_{Design} \sqrt{(P/v)_{B-Act}} \tag{10}$$

$$P_{B-Calc} = (m_{B-Act}/K_{Design})^2 \, v_{B-Calc}|_{h=f(P,T)} \tag{11}$$

where in these equations, and as used below:

$m_{B-Act}$=Actual mass flow at the turbine's inlet (termed its "Bowl"), an obtained inlet flow, lbm/hr (kg/sec)

$m_{B-Calc}$=Calculated mass flow at the turbine's inlet consistent with $K_{Design}$, lbm/hr (kg/sec)

$m_{B-Design}$=Design mass flow at the turbine's inlet, lbm/hr (kg/sec)

$K_{Actual}$=Calculated Flow Passing Ability constant based on actual pressure, specific volume and obtained inlet flow conditions.

$K_{Design}$=Flow Passing Ability constant obtained from design conditions, that is determined, Eq.(9), using the turbine's design flow, design pressure and design specific volume associated with a chosen location (as at the inlet to a turbine stage group).

$P_{B-Act}$=Actual pressure inlet (Bowl) to a turbine stage group, psiA (barA)

$P_{B-Calc}$=Calculated pressure inlet (Bowl) to a turbine stage group, determined by iteration at constant enthalpy, see Eq.(11), psiA (barA)

$P_{B-Design}$=Design pressure inlet (Bowl) to a turbine stage group, psiA (barA)

$T_{B-Act}$=Actual temperature inlet (Bowl) to a turbine stage group, ° F. (° C.)

$T_{B-Design}$=Design temperature inlet (Bowl) to a turbine stage group, ° F. (° C.)

$v_{B-Act}$=Actual specific volume inlet (Bowl) to a turbine stage group, $ft^3$/lbm ($m^3$/kg)=f($P_{B-Act}$, $T_{B-Act}$)

$v_{B-Design}$=Design specific volume inlet (Bowl) to a turbine stage group, $ft^3$/lbm ($m^3$/kg)=f($P_{B-Design}$, $T_{B-Design}$)

$v_{B-Calc}$=Calculated specific volume inlet (Bowl) to a turbine stage group determined by iteration at constant enthalpy, see Eq.(11) and discussion below, $ft^3$/lbm ($m^3$/kg)

As the IP turbine's inlet nozzles erode and/or otherwise age, degradation (an increase) in its actual Flow Passing Ability may be monitored by measuring the inlet pressure and temperature, and then computing the turbine's inlet mass flow rate, $m_{B-Calc}$, via Eq.(10). Differences between $m_{B-Cal}$ and $m_{B-Design}$, or between $m_{B-Calc}$ and $m_{B-Act}$, are indicative of nozzle erosion. $m_{B-Act}$ may be determined by performing a mass balance on the turbine cycle from a point where the working fluid's flow is measured, to the IP turbine's inlet. If computing a mass balance to resolve $m_{B-Act}$, account must be made for the turbine's steam path flow losses, e.g., turbine seal flows, extraction flows, and the like; and also account must be made for flow gains such as attemperation flows (i.e., in-flows used to control steam temperatures), and the like. However for monitoring purposes such determinations may bear considerable error due to uncertainties in $m_{B-Design}$ when comparing to the actual power output, or in the determination of $m_{B-Act}$.

Alternatively, the power plant engineer may assume a $m_{B-Act}$ value at design flow, or employ a constant fraction of the routinely measured feedwater flow and compute $P_{B-Calc}$ using Eq.(11). $P_{B-Calc}$ is then compared to the measured pressure $P_{B-Act}$; if $P_{B-Act}<P_{B-Calc}$ for a given power, the nozzle is eroded. Eq.(11) is deceptively complex in that an iterative procedure is require for solution. Each iteration made at an assumed constant enthalpy. Such a iterative procedure is available from Exergetic Systems, Inc. of San Rafael, Calif. (web site at www.ExergeticSystems.com) through its EX-PROP computer program; in 2005 EX-PROP was licensed for $350. The procedure involves plotting turbine data on a Mollier Diagram but ignoring turbine inlet data (which might be influenced by nozzle erosion), extrapolating the expansion line upwards to an assumed IP Bowl condition, choosing an enthalpy ($h_{B-Act}$) which crosses the extrapolated expansion line near the Bowl, then use EX-PROP to resolve $P_{B-Act}$ at the chosen enthalpy. This process is repeated until the state point ($P_{B-Act}$, $T_{B-Act}$ and $h_{B-Act}$) lies on the extrapolated expansion line thus satisfying the design Flow Passing Ability at the turbine's inlet mass flow, $m_{B-Act}$, as determined.

Alternatively, as an IP turbine's inlet nozzles erode and/or otherwise ages, its actual Flow Passing Ability, $K_{Actual}$, may be determined through measurement of the actual inlet pressure, the actual inlet temperature, and an obtained inlet mass flow, $m_{B-Act}$.

$$K_{Actual} = m_{B-Act} \Big/ \sqrt{(P/v)_{B-Act}} \tag{12}$$

Given nozzle degradation, the actual Flow Passing Ability constant, $K_{Actual}$, will generally indicate marked sensitivity when compared to the design value, $K_{Design}$. The obtained inlet mass flow may be had as discussed above. When degraded: $K_{Actual}>K_{Design}$ This method is the preferred embodiment given greater observed sensitivity.

Implementation

Figure 3:
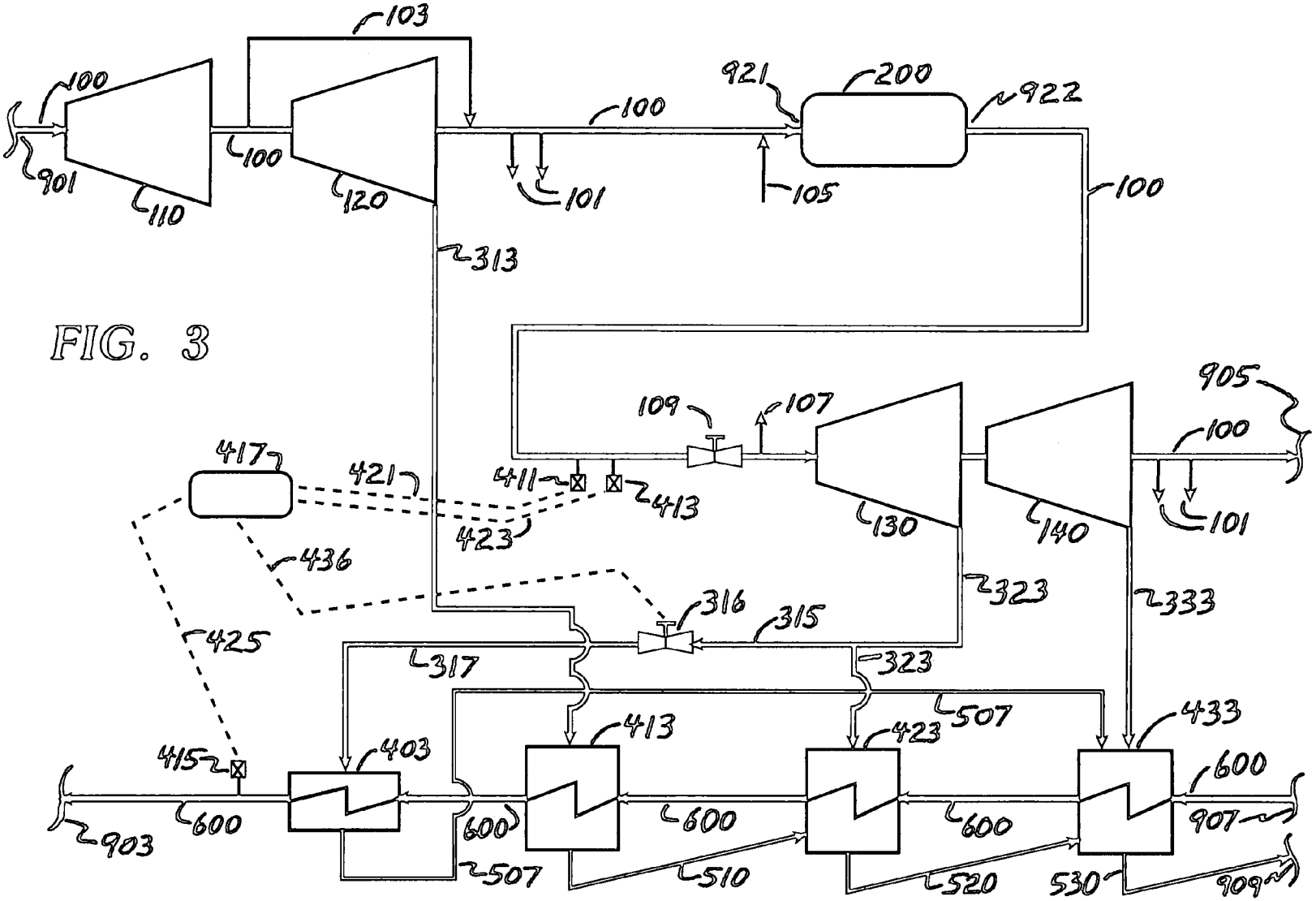
FIG. 3 illustrates the same portion of the regenerative Rankine cycle as shown in FIG. 1, but modified with the Exergetic Heater and associated control apparatus, achieving the advantages of the present invention.

To implement the present invention an Exergetic Heater is placed between the top feedwater heater and the steam generator. In addition, as seen in FIG. 3, a control valve is placed in an extension of the IP turbine's extraction line, said extension leading to the Exergetic Heater. The Exergetic Heater is used to control the final feedwater temperature to a pre-determined final feedwater temperature set-point. If no erosion is present in the first stage of the IP turbine, and the system is at full power, the control valve would typically be closed. However, for most of the plant's operational life, it is anticipated that this valve would control against the effects of IP turbine nozzle erosion. In addition, this valve could achieve, through control, a higher final feedwater temperature when at lower loads; that is off-setting intrinsically lower HP exhaust pressures as turbine cycle working fluid flow is reduced.

Figure 4:
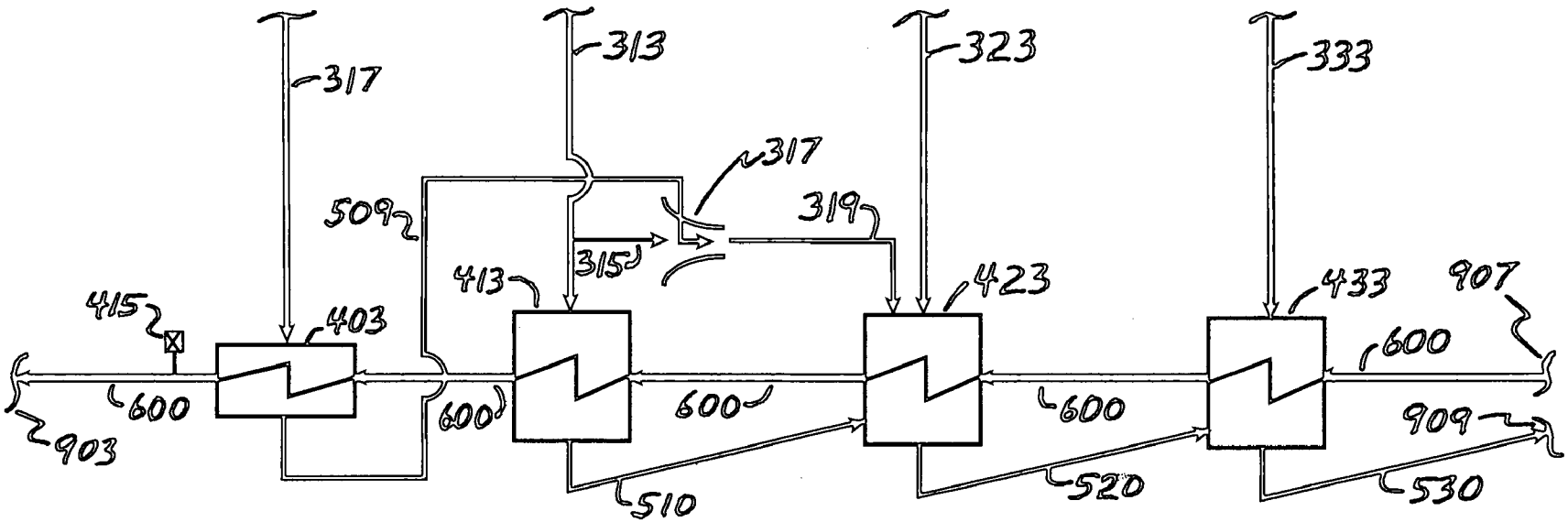
FIG. 4 illustrates only the HP feedwater heating portion of the regenerative Rankine cycle as shown in FIG. 1, but modified with the Exergetic Heater illustrating the outlet shell-side fluid from the Exergetic Heater being routed to a higher pressure heater achieved through use of a diffuser.

When FIG. 1, showing prior art, is compared to FIG. 3 or FIG. 4, it becomes evident how the present invention may be implemented. The placement of the Exergetic Heater will be downstream from the last of the system's original feedwater heaters, and before the steam generator's first heat exchanger (typically the Economizer for a fossil fueled system). Use of IP turbine extraction steam is warranted for its high temperature, and, in the preferred embodiment, from a mid-point IP turbine extraction as shown in FIG. 3. Use of the highest practical extraction temperate is needed to heat the feedwater using minimum extraction flow. It is anticipated by design, and desirable, that the Exergetic Heater shell-side outlet fluid conditions be in a saturated state, it being routed to the shell-side of the now fourth heater (the third highest pressure heater of the original heaters, 433 in FIG. 3). Alternatively, the Exergetic Heater shell-side outlet fluid conditions may consist of sub-cooled liquid, it then being routed to the drain section of the shell-side of the third highest pressure heater of the original heaters, 433 in FIG. 3.

The Exergetic Heater's shell-side outlet fluid conditions normally would be routed to one feedwater heater below (in extraction pressure) than that heater which is associated with supplying it extraction steam; i.e., outlet fluid 507 from 403 is routed to heater 433 (not 423) in FIG. 3. The reason for this is to provide the shell-side outlet fluid a pressure head which will drive its flow to a heater of lower pressure. This is the preferred embodiment; in addition to a driving pressure head, thermodynamic conditions (assuming 20% quality exiting from the Exergetic Heater) more closely matches the lower pressure heater's shell-side conditions.

However, there may be situations in which the Exergetic Heater's shell-side outlet fluid conditions must be routed to the same feedwater heater which is associated with supplying it extraction steam; see extraction steam 323 in FIG. 3 which supplies both feedwater heater 423 and the Exergetic Heater 403. Such a situation may arise if an inadequately small pressure drop is employed across the control valve (i.e., the control valve 316 is wide-open and heater 433 in FIG. 3 is not appropriate to receive the outlet shell-side fluid 507 from the Exergetic Heater 403). As seen in FIG. 4, such flow to a higher pressure heater is accomplished using a diffuser 317 which employs motive steam 315 from the extraction 313 (313 supplying heater 413), the mixed flow 319 from diffuser 317 is delivered to feedwater heater 423. If HP turbine exhaust conditions are not adequate for motive steam requirements, then throttle conditions (901 in FIG. 3) may be employed. Such diffusers are common, one manufacturer is Artisan Industries Inc. of Waltham, Mass. (info@ArtisanInd.com).

An objective of the present invention is controlling the final feedwater temperature associated with a regenerative Rankine cycle. This is accomplished by manual adjustment of a control valve (e.g., manual operation of control valve 316 in FIG. 3), or through an automated system employing a controller (e.g., 417 in FIG. 3). If a controller is used it would receive, at a minimum, a signal of the actual final feedwater temperature to actuate the control valve such that the actual final feedwater temperature agrees with a determined final feedwater temperature set-point within a defined tolerance. Such defined tolerance may be taken as 1.8° ΔF. (1° ΔC.), or that which may be accomplished using common industrial art which is the preferred embodiment. The final feedwater temperature set-point may be a constant value; or the final feedwater temperature set-point may vary as a function of power output thus accounting for variations in turbine cycle extraction conditions as load is reduced.

Further, determination of the final feedwater temperature set-point, at a given power output, may be determined in an iterative manner such that system thermal efficiency is maximized. As taught in the first section above, turbine cycle efficiency is linear with Useful Energy Flow Supplied ($\Sigma m\Delta h$) given constant power, thus the controller would be expected to response in a linear manner to any degradation in the final feedwater temperature. Indeed, the computation of turbine cycle efficiency in real-time is considered common art, see Eqs.(5) and (2). However, as taught above, affects of final feedwater temperature on boiler efficiency are non-linear, see Eq.(8) and associated discussions, and may oppose turbine cycle efficiency. Therefore it becomes necessary to compute boiler efficiency in real-time. Thus the resultant system thermal efficiency may be computationally optimized by simply varying the final feedwater temperature set-point until system thermal efficiency is maximized, determined by computing both turbine cycle and boiler efficiencies. Such efficiency computations may occur within the controller (417 in FIG. 3), or may occur in a personal computer whose output signal is the optimized final feedwater temperature set-point. The optimized final feedwater temperature set-point then becomes an input signal to the controller such that it actuates the control valve (e.g., 316 in FIG. 3) until the final feedwater temperature agrees with the final feedwater temperature set-point.

Further still, knowledge of degradation in the IP turbine inlet nozzle, as taught in the second section above, may add important information for refining the control of the final feedwater temperature. If the Flow Passing Ability of the IP turbine is evaluated as taught herein, in real-time, then an off-setting action may ensue within the controller. Such off-setting action is based on the design IP turbine inlet pressure to be expected if no nozzle degradation was present. This pressure, $P_{B\text{-}Design}$, discussed above, is then translated to a positive change in final feedwater temperature based on Δsaturated temperatures. Eqs.(13) & (14) terms are defined as follows: $\Delta P/P_{Ext}$ is the relative pressure change from the IP turbine inlet minus the shell-side of the Exergetic Heater divided by the IP turbine inlet; $T_{Act\text{-}FW}$ is the actual final feedwater temperature; and $T_{sat/Act}$ is the actual shell-side saturation temperature associated with the top feedwater heater:

$$T_{sat/Design} f\,[P_{B\text{-}Design}(1.0-\Delta P/P_{Ext})] \tag{13}$$

$$T_{Final\text{-}FW}=T_{Act\text{-}FW}+(T_{sat/Design}-T_{sat/Act}) \tag{14}$$

It is to be noted that computing the Flow Passing Ability of the IP turbine in real-time may have importance since it is not uncommon to fine Hot Reheat temperature off-design, which directly impacts a computed Flow Passing Ability, aside of nozzle erosion. This suggests that for some situations, a superficial evaluation of IP turbine performance by only monitoring extraction pressure (thus saturation temperature) may not be acceptable.

To teach an actual application of the present invention, consider the case found at the St. Clair Station, Units 1, 4 and 6, operated by Detroit Edison (owned by DTE Energy Corporation of Detroit, Mich. with regulatory governance provided by the Michigan Public Service Commission, 6545 Mercantile Way, Suite 7, Lansing, Mich. 48911, FAX 517-241-6191). Units 1 and 4 were originally designed to produce 170 MWe each, Unit 6 was originally designed to produce 336 MWe. All are coal-fired. At full load, Unit 1's final feedwater temperature was found degraded by 12.9Δ° F. (7.2Δ° C.), Unit 4's final feedwater temperature was found degraded by 14.4Δ° F. (8.0Δ° C.), and Unit 6's final feedwater temperature was found degraded by 9.2Δ° F. (5.1Δ° C.). Units 1 and 4 were unable to produce design power given limitations to feedwater and combustion air flows, aggravated by degradation in feedwater temperatures; degradation in Unit 1 was 25 ΔMWe (worth $8 million/year in power sales at $40/MWe-hour), degradation in Unit 4 was 18 ΔMWe (worth $5.8 million/year in power sales). At the time of testing Unit 6 was capable of producing design power. The general Exergetic Heater arrangement indicated in FIG. 3 was assumed, using a conservative feedwater temperature increase of 10.0Δ° F. (5.6Δ° C.) achieved by the Exergetic Heater taking extraction steam from 323 via 315 and 317. To achieve this improved final feedwater temperature, an increase in IP turbine 130 extraction flow 323 is required from 6.33% of feedwater flow to 7.64%. The Exergetic Heater was designed to produce shell-side steam at 20% quality as delivered via 507 to the third highest pressure feedwater heater (433 in FIG. 3) with an adequate pressure head; its flow 507 being 1.31% of feedwater flow. This application, conservatively estimated using a 10.0Δ° F. (5.6Δ° C.) improvement, will recover at least 400 ΔBtu/kWh in heat rate worth an estimated $12 million in fuel costs/year; total savings for the three units could exceed $20 million/year.

Although the present invention has been described in considerable detail with regard to certain preferred embodiments thereof, other embodiments within the scope of the present invention are possible without departing from the spirit and general industrial applicability of the invention. Accordingly, the general theme and scope of the appended claims should not be limited to the descriptions of the preferred embodiment disclosed herein. For example, the working fluid discussed in the specification herein has been water. The invention may apply to any fluid, as long as it is a working fluid to a regenerative Rankine cycle. Further, the definition of an Exergetic Heater (formally provided below) is presented as a most general concept. Further still, the source of working fluid (e.g., extraction steam) used to heat feedwater within an Exergetic Heater may be taken from any appropriate location within the regenerative Rankine cycle or the steam generator. This invention is especially applicable to power plants fueled by fossil fuel employing a Reheater in its steam generator, the reheated steam being delivered to an Intermediate Pressure (IP) turbine. However, this invention is also applicable to any thermal system consisting of a generator of heated working fluid (i.e., the term "steam generator" is defined below), and a regenerative Rankine cycle with reheat.

THE DRAWINGS

Figure 2:
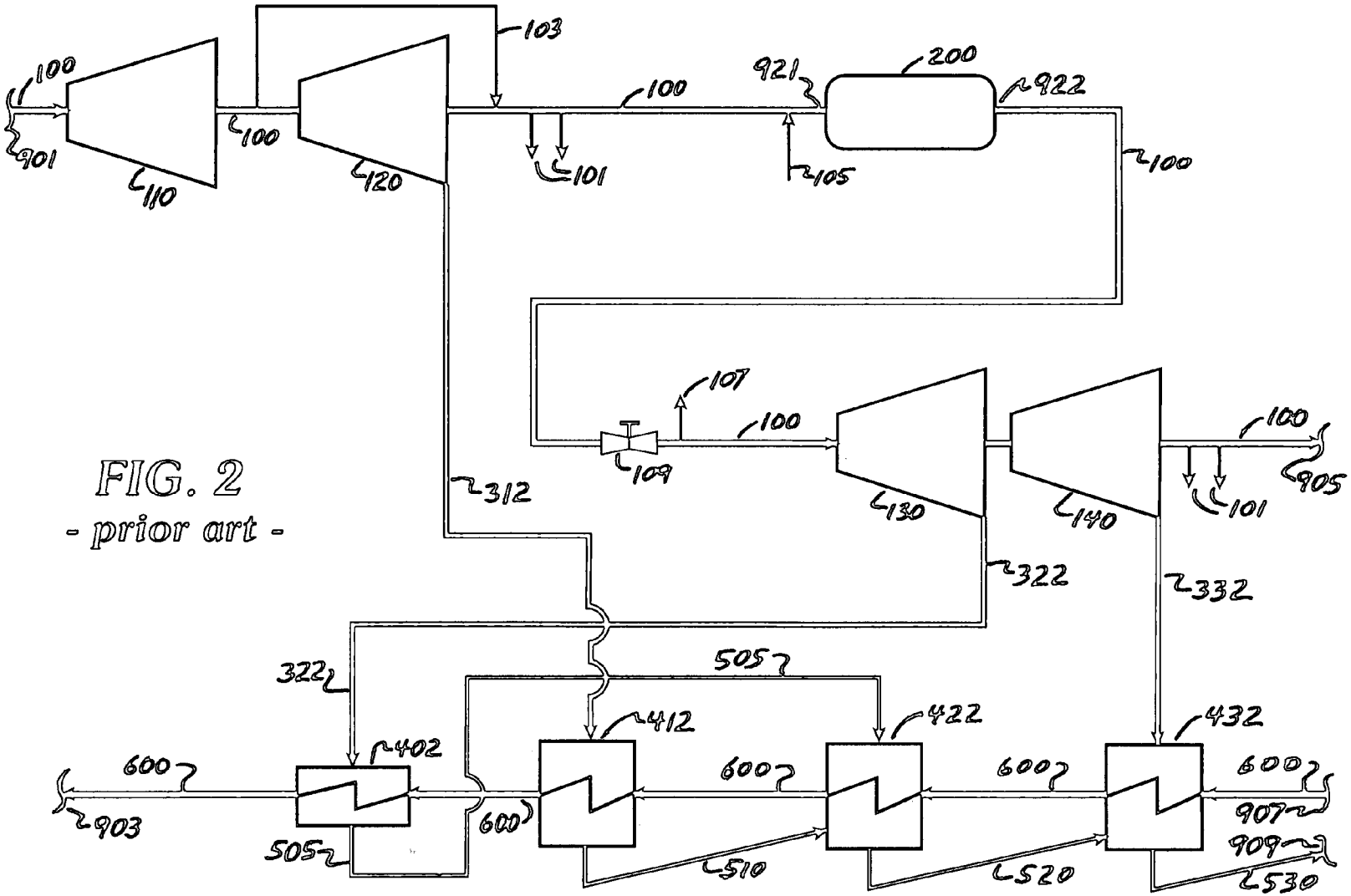
FIG. 2 illustrates a portion of a typical regenerative Rankine cycle of a typical design used in Europe, it is an example of prior art.

FIG. 1 and FIG. 2 represent the high pressure (HP) portion of typical regenerative Rankine cycles employing a reheating 200 of the working fluid, but illustrating different feedwater heater configurations. FIG. 1 illustrates a design principally used in North America. FIG. 2 illustrates a design principally found in Europe. FIG. 1 and FIG. 2 are prior art. Since the regenerative Rankine cycle has been in use for over a hundred years, numerous variations have evolved. Variations to the turbine configurations of these cycles, versus that assumed in FIG. 1 and FIG. 2, which does not impact the spirit and general industrial applicability of the present invention include, for example: turbine shaft leakage locations and routings; location and/or use of Reheater attemperation; the HP turbine could be replaced with a Very High Pressure (VHP) turbine followed by a First Reheater, followed by an HP turbine followed by Second Reheater (replacing 110, 120 and 200); valve leakages may take numerous configurations (i.e., variations to that illustrated by 101); etc. Variations to feedwater heater configurations of these cycles, versus that assumed in FIG. 1 and FIG. 2, which does not impact the spirit and general industrial applicability of the present invention include, for example: use of contact heaters; use of a contact heater in place of 430 in FIG. 1, or 432 in FIG. 2, such placement commonly termed a "Deaerator" in North America or a "Feed Tank" in Europe and with associated drain pumps; feedwater heater drains may be pumped forward (for example: 520 in FIG. 1, which is shown to drain to heater 430, could be routed instead by pump directly to the feedwater path 600 between heaters 410 and 420); feedwater pumps (not shown in these figures) may be placed anywhere in the feedwater path 600, their arrangement and use not affecting the invention; etc. Such modifications, and others, do not affect the scope of the present invention as they do not concern themselves with: the placement of an Exergetic Heater downstream from the original top heater and before the steam generator; an Exergetic Heater whose steam used for heating feedwater is derived from the system (typically from a turbine extraction); and/or the feedwater heating conducted by an Exergetic Heater whose heating is being controlled by certain thermal performance parameters as described herein.

FIG. 1, FIG. 2 and FIG. 3 employ some of the same designation numbers for the same features. These same designations are listed in this paragraph and in the following paragraph. Item 100 indicates the principle steam path flow through the HP turbines 110 & 120, the Reheater 200, the Intercept Valve 109, and the IP turbines 130 and 140. Item 110 is the Governing Stage of the HP turbine. Item 120 is the Second Stage Group of the HP turbine. Item 130 is the First Stage Group of the IP turbine. Item 140 is the Second Stage Group of the IP turbine. Each stage group typically contains two or more individual stages; each stage consisting of a fixed ring of nozzles followed by rotating turbine blading attached to the turbine's shaft. Item 103 represents typical seal flow exiting from the Governing Stage 110 and flowing to the HP turbine's exhaust, i.e., between 120 and the Reheater 200. Item 101 represents minor leakages from the turbine and the end of the turbine casings (both HP and IP). Item 109 is the Intercept Valve with its associated leakage 107. The feedwater path 600 illustrates feedwater flowing through the tube-side of feedwater heaters, said heaters being further described below. FIG. 1, FIG. 2 and FIG. 3 represents the high pressure portion of a regenerative Rankin cycle showing the HP turbine 110 and 120, and the IP turbine 130 and 140; it shows three sources of extraction steam: from the Second Stage Group of the HP turbine 120 (HP exhaust), and from the First and Second Stage Groups of the IP turbine 130 and 140.

For FIG. 1, FIG. 2 and FIG. 3 item 901 represents the boundary between the regenerative Rankine cycle and the steam generator indicating steam being delivered from the steam generator. The enthalpy associated with 901 is described by $h_{Throttle}$ of Eq.(5). Item 903 represents the boundary between the regenerative Rankine cycle and the steam generator indicating feedwater being delivered to the steam generator. The temperature and enthalpy associated with the boundary 903 are described by $T_{Final\text{-}FW}$ and $h_{Final\text{-}FW}$. $h_{Final\text{-}FW}$ is a parameter used in Eq.(5). $T_{Final\text{-}FW}$ is the final feedwater temperature. Item 921 represents the boundary between the regenerative Rankine cycle and the steam generator indicating HP turbine exhaust steam being delivered to the Reheater 200, an integral steam generator heat exchanger. The enthalpy associated with 921 is described by $h_{CRH}$ of Eq.(5), termed Cold Reheat (CRH). Item 922 represents the boundary between the regenerative Rankine cycle and the steam generator indicating re-heated steam being delivered from steam generator's Reheater 200. The enthalpy associated with 922 is described by $h_{HRH}$ of Eq.(5), termed Hot Reheat (HRH). Item 905 represents a continuation of the regenerative Rankine cycle, those main steam flow 100 typically would flow to the cycle's LP turbine. Item 907 represents a continuation of the regenerative Rankine cycle, those feedwater path 600 typically would flow from the cycle's LP feedwater heaters. Item 909 represents a continuation of the regenerative Rankine cycle, those HP feedwater heater drain flow is being delivered to the next upstream LP feedwater heater (not shown).

For FIG. 1 feedwater heaters are designated as the top heater 410 (i.e., the highest pressure heater), the second highest pressure heater 420, and the third highest pressure heater 430. Relative to FIG. 3, these three heaters are considered "original" heaters, that is before the application of the present invention. Heater 410 receives extraction steam 310 from HP turbine 120. Heater 410 drains 510 to heater 420. Heater 420 receives extraction steam 320 from IP turbine 130. Heater 420 drains 520 to heater 430. Heater 430 receives extraction steam 330 from IP turbine 140. Heater 430 drains 530 to the LP portion of the regenerative Rankine cycle, its continuation designated 909.

For FIG. 2 feedwater heaters are designated as the top heater 402, the second heater 412, the third heater 422, and the fourth heater 432. Heater 402 receives extraction steam 322 from IP turbine 130. Heater 402 delivers its steam 505 (which is typically superheated) to the shell-side of heater 422. Heater 412 receives extraction steam 312 from HP turbine 120. Heater 412 drains 510 to heater 422. Heater 422 receives is motive steam 505 from the top heater 402. Heater 422 drains 520 to heater 432. Heater 432 receives extraction steam 332 from IP turbine 140. Heater 432 drains 530 to the LP portion of the regenerative Rankine cycle, its continuation designated 909.

For FIG. 3 feedwater heaters are designated as the Exergetic Heater 403, the original top (first) heater 413 before application of the present invention (i.e., receiving the highest pressure extraction steam 313 from the HP turbine 120), the second of the original heaters and the second highest pressure heater 423, and the third of the original heaters and the third highest pressure heater 433. The Exergetic Heater 403 receives extraction steam 317 by way of IP turbine 130 extraction 323, by way of 315 through control valve 316 connected to 317. Heater 403 delivers its outlet shell-side fluid 507 (typically saturated steam) to the shell-side of heater 433. Heater 413 receives extraction steam 313 from HP turbine 120. Heater 413 drains 510 to heater 423. Heater 423 receives extraction steam 323 from IP turbine 130. Heater 423 drains 520 to heater 433. Heater 433 receives extraction steam 333 from IP turbine 140, and also receives outlet shell-side fluid 507 from the Exergetic Heater 403. Heater 433 drains 530 to the LP portion of the regenerative Rankine cycle, its interface designated 909. For FIG. 3 thermal performance instrumentation includes an instrument 411 measuring the inlet pressure of the IP turbine having an output signal 421, an instrument 413 measuring the inlet temperature of the IP turbine having an output signal 423, and an instrument 415 measuring the final feedwater temperature, $T_{Final\text{-}FW}$, before said feedwater enters the steam generator 903 having an output signal 425. Actuation of the Control Valve 316 is achieved through a control device 417 whose output signal 436, controlling 316, is based in part on the input signals 421, 423 and 425.

FIG. 4 represents only the feedwater path 600 and HP feedwater heaters as depicted in FIG. 3 and FIG. 1, showing a modification of how the outlet shell-side fluid 509 from Exergetic Heater 403 may be routed to feedwater heater 423. The feedwater path 600 illustrates the feedwater flowing through the tube-side of feedwater heaters. Item 903 represents the boundary between the regenerative Rankine cycle and the steam generator indicating feedwater being delivered to the steam generator. The enthalpy associated with 903 is described by $h_{Final\text{-}FW}$ of Eq.(5). Item 907 represents a continuation of the regenerative Rankine cycle, whose feedwater path 600 typically would flow from the cycle's LP feedwater heaters to heater 433. Item 909 represents a continuation of the regenerative Rankine cycle, those HP feedwater heater drain flow is being delivered to the next upstream LP feedwater heater. For FIG. 4 feedwater heaters are designated as the Exergetic Heater 403, the original top (first) heater 413 before application of the present invention (i.e., receiving the highest pressure extraction steam 313 from the HP turbine 120, see FIG. 3), the second of the original heaters and the second highest pressure heater 423, and the third of the original heaters and the third highest pressure heater 433. The Exergetic Heater 403 receives extraction steam 317 originating from the IP turbine 130 (see FIG. 3). Exergetic Heater 403 delivers its outlet shell-side fluid 509 (typically saturated steam) to the diffuser 317. The diffuser's 317 motive steam 315 originates from the HP turbine by way of extraction 313. The diffuser's output 319 is delivered to the shell-side of heater 423 at a higher pressure than the extraction 323. Heater 413 receives extraction steam 313 from HP turbine 120 (see FIG. 3). Heater 413 drains 510 to heater 423. Heater 423 receives extraction steam 323 from the IP turbine 130 (see FIG. 3), and also receives steam 319 as diffuser output 317. Heater 423 drains 520 to heater 433. Heater 433 receives extraction steam 333 from IP turbine 140 (see FIG. 3). Heater 433 drains 530 to the LP portion of the regenerative Rankine cycle, its continuation designated 909.

For FIG. 1 and elsewhere herein, including CLAIMS, if used, the words "obtain", "obtained", "obtaining", "determine", "determined", "determining" or "determination" are defined as measuring, calculating, computing by computer, assuming, estimating or gathering from a database. The words "establish", "established" or "establishing" are defined as measuring, calculating, computing by computer, assuming, estimating or gathering from a database.

For FIG. 1 and elsewhere, including CLAIMS, the words "Exergetic Heater" is a term defined herein as a heater exchanger in which the final feedwater associated with a regenerative Rankine cycle is heated by the system's working fluid of appropriate energy flow for feedwater heating in preferred embodiment driven from an Intermediate Pressure (IP) turbine extraction. In the preferred embodiment, the Exergetic Heater has a shell-side and tube side configuration as depicted as 403 in FIG. 3 having drains 507, or as depicted as 403 in FIG. 4 having drains 509, said drains flowing to another feedwater heater. Exergetic Heater 403 receives its heating steam from IP extraction 323 routed through pipe 315, control valve 316 and pipe 317. The Exergetic Heater may also be a contact heat exchanger in which the turbine extraction steam is directly mixed with, and condensed by, the feedwater. The resultant heated feedwater is then pumped to the steam generator; concern about routing drain flows is eliminated. In the preferred embodiment, the system's working fluid of appropriate energy flow for feedwater heating within the Exergetic Heaters derived from the turbine's extraction as depicted in FIG. 3.

For FIG. 1 and elsewhere, including CLAIMS, the words "steam generator" is a term defined herein as meaning any device or method which adds heat to any working fluid (not just water). In conventional usage, a steam generator burns a fossil fuel, heat from that combustion is taken up by water to the point that a superheated state is reached, i.e., steam is produced. Although "steam generator" invokes a heating of water, its definition as defined herein is taken for readability.

What is claimed is:

1. A method for quantifying the operation of a thermal system in which a final feedwater temperature is to be controlled, the thermal system consisting of a steam generator and a regenerative Rankine cycle having an Intermediate Pressure turbine and a feedwater path, the method comprising the steps of:

installing a heat exchanger in the feedwater path upstream from the steam generator, resulting in an Exergetic Heater;

routing a source of working fluid from the Intermediate Pressure turbine, applicable for feedwater heating, to the Exergetic Heater; and controlling the final feedwater temperature by adjusting the source of working fluid from the Intermediate Pressure turbine.

2. The method of claim 1, wherein in step of controlling the final feedwater temperature includes the steps of:

obtaining a final feedwater temperature set-point;

controlling the final feedwater temperature by adjusting the source of working fluid such that the final feedwater temperature set-point is reasonably achieved.

3. The method of claim 2, wherein the step of obtaining the final feedwater temperature set-point includes the step of:

obtaining the final feedwater temperature set-point which is a function of power output produced by the thermal system.

4. The method of claim 2, wherein the step of obtaining the final feedwater temperature set-point includes the steps of:

determining a boiler efficiency applicable to the steam generator;

optimizing the boiler efficiency by varying the final feedwater temperature set-point until a maximum value of the boiler efficiency is achieved, resulting in the final feedwater temperature set-point which is optimized.

5. The method of claim 2, wherein the step of obtaining the final feedwater temperature set-point includes the steps of:

determining a boiler efficiency applicable to the steam generator;

determining a turbine cycle efficiency applicable to the regenerative Rankine cycle;

determining a system thermal efficiency based on the boiler efficiency and the turbine cycle efficiency; and optimizing the system thermal efficiency by varying the final feedwater temperature set-point until a maximum value of the system thermal efficiency is achieved, resulting in the final feedwater temperature set-point which is optimized.

6. The method of claim 1, including after the step of controlling the final feedwater temperature, the additional step of:

routing an outlet shell-side fluid from the Exergetic Heater to a feedwater heater.

7. The method of claim 1, including after the step of controlling the final feedwater temperature, the additional step of:

routing an outlet shell-side fluid from the Exergetic Heater based on the available pressure head required for draining the outlet shell-side fluid from the Exergetic Heater.

8. The method of claim 1, including after the step of controlling the final feedwater temperature, the additional steps of:

installing a diffuser intended to deliver an outlet shell-side fluid from the Exergetic Heater at a higher pressure;

routing a motive working fluid from the thermal system to the diffuser; and routing the outlet shell-side fluid from the Exergetic Heater through the diffuser, operated by the motive working fluid, to a higher pressure.

9. The method of claim 4, wherein the step of determining the boiler efficiency applicable to the steam generator includes the step of:

determining the boiler efficiency applicable to the steam generator based on a procedure selected from the group comprising an Input/Loss Method, an ASME PTC 4 Method, an ASME PTC 4.1 Method, a DIN 1942 Method, a Control-Oriented Method and a DCS-Based Method.

10. The method of claim 5, wherein the step of determining the boiler efficiency applicable to the steam generator includes the step of:

determining the boiler efficiency applicable to the steam generator based on a procedure selected from the group comprising an Input/Loss Method, an ASME PTC 4 Method, an ASME PTC 4.1 Method, a DIN 1942 Method, a Control-Oriented Method and a DCS-Based Method.

11. A device for a thermal system in which a final feedwater temperature is to be controlled, said thermal system consisting of a steam generator and a regenerative Rankine cycle having an Intermediate Pressure turbine and a feedwater path, the device comprising:

a heat exchanger installed in the feedwater path of the regenerative Rankine cycle and before the steam generator with a means of feedwater heating, resulting in an installed Exergetic Heater;

an instrument for measuring a final feedwater temperature between the installed Exergetic Heater and the steam generator, having an output final feedwater temperature signal;

a control valve having an inlet connection and an outlet connection;

a pipe carrying fluid from the Intermediate Pressure turbine to the inlet connection of the control valve; and a pipe carrying fluid from the outlet connection of the control valve to the installed Exergetic Heater; and a control device for controlling the final feedwater temperature having as an input signal the output final feedwater temperature signal, and having an output signal which actuates the control valve such that the final feedwater temperature is controlled.

12. The device of claim 11 wherein the heat exchanger installed in the feedwater path, also comprises:

a heat exchanger having a shell-side and tube-side configuration installed in the feedwater path of the regenerative Rankine cycle and before the steam generator with a means of feedwater heating, resulting in an installed Exergetic Heater.

13. The device of claim 11 wherein the instrument for measuring the final feedwater temperature includes:

a Resistance Temperature Detector instrument, also termed RTD, for measuring a final feedwater temperature between the installed Exergetic Heater and the steam generator, having an output final feedwater temperature signal.

14. The device of claim 11 wherein the instrument for measuring the final feedwater temperature includes:

a thermocouple instrument for measuring a final feedwater temperature between the installed Exergetic Hater and the steam generator, having an output final feedwater temperature signal.

15. The device of claim 11 wherein the control device for controlling the final feedwater temperature includes:

a means to determine boiler efficiency, having an output boiler efficiency signal;

the control device for controlling the final feedwater temperature having as input signals the output final feedwater temperature signal and the output boiler efficiency signal, and having an output signal which actuates the control valve such that the final feedwater temperature is controlled.

16. The device of claim 11 wherein the control device for controlling the final feedwater temperature includes:

a Proportional Integral Derivative controller device, also termed PID, for controlling the final feedwater temperature having as an input signal the output final feedwater temperature signal, and having an output signal which actuates the control valve such that the final feedwater temperature is controlled.

17. The device of claim 11 wherein the control device for controlling the final feedwater temperature includes:

a pneumatic control device for controlling the final feedwater temperature having as an input signal the output final feedwater temperature signal, and having an output signal which actuates the control valve such that the final feedwater temperature is controlled.

18. A method for quantifying the operation of a thermal system in which a final feedwater temperature is to be controlled, the thermal system consisting of a steam generator and a regenerative Rankine cycle having an Intermediate Pressure turbine and a feedwater path carrying a flow of feedwater, the method comprising the steps of:

installing a heat exchanger having a shell-side and a tube-side in the feedwater path of the regenerative Rankine cycle and upstream from the steam generator, resulting in an Exergetic Heater;

obtaining a final feedwater temperature associated with optimum operation of the steam generator, resulting in an optimized final feedwater temperature;

routing an extraction steam source from the Intermediate Pressure turbine to the shell-side of the Exergetic Heater;

routing the flow of feedwater to the tube-side of the Exergetic Heater; and controlling the extraction steam source such that the optimized final feedwater temperature is achieved.

* * * * *

UNITED STATES PATENT AND TRADEMARK OFFICE

CERTIFICATE OF CORRECTION

PATENT NO. : 7,040,095 B2
APPLICATION NO. : 11/204898
DATED : May 9, 2006
INVENTOR(S) : Fred D. Lang It is certified that error appears in the above-identified patent and that said Letters Patent is hereby corrected as shown below:

Column 2,
Line 58, delete "highest pressure heaters" and
insert -- highest pressure LP heaters --

Column 7,
Eq.(6C) on Lines 13-14 should read as follows:
-- $\partial\eta_{Unit}/\partial P = \{1.0 - [\partial(m_{AF}HHV)/m_{AF}HHV]/[\partial P/P]\}/(m_{AF}HHV)$ (6C) --

Column 7,
Eq.(7B) on Lines 13-14 should read as follows:
-- $\partial\eta_{Unit}/\partial(\Sigma m\Delta h) = [\partial P/\partial(\Sigma m\Delta h)$
$- \eta_{Unit}\partial(m_{AF}HHV)/\partial(\Sigma m\Delta h)] / (m_{AF}HHV)$ (7B) --

Column 9,
Eq.(11) on Line 32 should read as follows:
-- $P_{B\text{-}Calc} = (m_{B\text{-}Act}/K_{Design})^2 \, v_{B\text{-}Calc} \big|_{h = f(P,T)}$ (11) --

Column 11,
Line 18, delete "extraction temperate" and insert -- extraction temperature --

Column 12,
Eq.(13) on Line 52 should read as follows:
-- $T_{sat/Design} \equiv f[P_{B\text{-}Design}(1.0 - \Delta P/P_{Ext})]$ (13) --

Column 16,
Lines 58-59, delete "heater exchanger" and insert -- heat exchanger --

Signed and Sealed this

Twenty-first Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 7,040,095 B2
APPLICATION NO. : 11/204898
DATED : May 9, 2006
INVENTOR(S) : Fred D. Lang It is certified that error appears in the above-identified patent and that said Letters Patent is hereby corrected as shown below:

Column 4,
Lines 6-7, delete "and exits as saturated steam or subcooled liquid;"
and insert:
-- and exits as saturated steam or subcooled liquid if pressure permits, otherwise as superheated steam; --

Column 11,
Lines 19-21, delete
"It is anticipated by design, and desirable, that the Exergetic Heater shell-side outlet fluid conditions be in a saturated state,"
and insert:
-- It is desirable, if the Exergetic Heater's shell-side exit pressure is sufficiently high, that its shell-side outlet conditions be in a saturated state, otherwise in a superheated state, --

Column 11,
Line 24, after "Alternatively," insert: -- if pressure permits, --

Signed and Sealed this

Twenty-fifth Day of December, 2007

JON W. DUDAS
*Director of the United States Patent and Trademark Office*